US006822603B1

(12) United States Patent
Crimmins et al.

(10) Patent No.: US 6,822,603 B1
(45) Date of Patent: Nov. 23, 2004

(54) METHOD AND APPARATUS FOR TRANSMITTING A PLURALITY OF DIFFERENT CODES AT A PLURALITY OF DIFFERENT FREQUENCIES

(75) Inventors: Terence E. Crimmins, Northport, NY (US); Eric J. Robb, Carol Stream, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 09/557,801

(22) Filed: Apr. 25, 2000

(51) Int. Cl.[7] ..... G08C 19/12

(52) U.S. Cl. ..... 341/176; 340/825.69; 455/352

(58) Field of Search ..... 341/176; 318/443, 318/265, 266; 340/825.69; 455/352, 353

(56) References Cited

U.S. PATENT DOCUMENTS 6,005,508 A * 12/1999 Tsui ..... 341/173

* cited by examiner

*Primary Examiner*—Michael Horabik
*Assistant Examiner*—Hung Dang
(74) *Attorney, Agent, or Firm*—Fitch, Even, Tabin & Flannery

(57) ABSTRACT

An RF transmitter capable of transmitting a plurality of different codes at a plurality of different frequencies is set forth herein. The transmitter offers a new way of multiplexing inputs so that fewer controller I/O ports are needed to read or determine the state of a plurality of inputs. More particularly, the controller is capable of using one pin as both an input port and output port and determines the state of various inputs by detecting changes to the I/O pin. The multiple inputs connected to the controller pin are also connected to a pull down resistor and capacitor, and the controller can determine what state the inputs are in by detecting whether the pin input is at a logic high, low, or some state in between.

11 Claims, 12 Drawing Sheets

| |
|---|
| FIG. 5A |
| FIG. 5B |
| FIG. 5C |
| FIG. 5D |

① SET PORT HI
② SET PORT TO INPUT
③ SET PORT LO

Ⓦ A CLOSED/B OPEN
Ⓧ A&B CLOSED
Ⓨ A&B OPEN
Ⓩ A OPEN/B CLOSED

READ 1 DETERMINES THE INITIAL CONDITIONS AND THE STATE OF SWITCH A.
READ 2 DETERMINES THE STATE OF SWITCH B.
READ 3 DETERMINES THE STATE OF SWITCH B.

COMPLETE MULTIPLEXER CIRCUIT

METHOD AND APPARATUS FOR TRANSMITTING A PLURALITY OF DIFFERENT CODES AT A PLURALITY OF DIFFERENT FREQUENCIES

BACKGROUND OF THE INVENTION

This invention relates generally to radio frequency (RF) transmitters and more particularly relates to RF transmitters capable of transmitting multiple codes at multiple frequencies.

Transmitters are becoming more and more widely used to control the operation of an ever increasing amount of devices and systems. Originally used for military applications and large-scale broadcasting needs, the transmitter has evolved to such an extent that it is now being used in applications as personal as medical implants. In fact it is becoming almost impossible to go without using a transmitter in our day-to-day lives. For example, our cars, garages, shutters, etc. may all be controlled via a transmitter.

Unfortunately, like all electronics, transmitters break, and become damaged and/or lost. When this happens, it often becomes necessary to purchase a new transmitter. Most manufacturers who sell products using transmitters offer replacement units for sale. In some industries, universal transmitters are offered for sale which can be used on a variety of products made by a variety of manufacturers. The garage door operator industry is one such industry.

In order to operate properly, universal movable barrier operator transmitters must be capable of transmitting a plurality of different codes (or code modulations) at a plurality of different frequencies (or carrier frequencies). These transmitters are sought after because consumers do not always know what type of transmitter they need, or they prefer having the security of knowing that they are getting a transmitter that will work with their system. Universal transmitters are also attractive to personnel who install and service movable barrier operators because they reduce the number of transmitters they need to stock and reduce the number of transmitters they need to learn how to program and/or operate. In addition, these transmitters can often times be sold for less than other replacement transmitters because the manufacturers can make up profit margins based on volume sales.

Unfortunately, in order to offer these capabilities, the electronic circuits comprising the transmitter become more complex, larger and expensive. For example, the addition of components can often create RF interference among the other components and/or require redesign of the circuit layout. Similarly, the added electronics often increase the size and expense of the circuit and may require the use of a larger, more expensive microprocessor or controller. Typically, only a portion of the larger controller is used which increases waste and lowers the efficiency of the overall circuit. This is because additional input and output (I/O) pins are required to handle the extra electronics required to produce multiple codes and frequencies.

To date, several attempts have been made to provide universal transmitters. One example is U.S. Pat. No. 5,564,101 to Eisfeld et al. which discloses a universal transmitter for use with a garage door opener which allows for a user to program a transmitted modulation format and carrier frequency and transmit a signal corresponding to the selections. This transmitter uses two sets of mechanical DIP switches to select the transmitter code and carrier frequency, but ties up individual I/O ports for each individual DIP switch. Such a configuration requires a larger controller having additional I/O ports, which will make the circuit more complex, increase the overall circuit size, and raise costs.

U.S. Pat. No. 5,661,804 to Dykema et al. discloses a learning transmitter which can operate a plurality of different receivers employing rolling or encrypted code. No user input is required to learn the code and frequency, other than activating the transmitter to be copied. A single RF circuit employing a phase locked loop frequency synthesizer and dynamically tunable antenna is provided for transmitting the learned code. Unfortunately, not all transmitters are functional when they are being replaced, so learning transmitters are not always available substitutes.

Accordingly, there is a need for a simple, smaller, and less expensive transmitter capable of transmitting a plurality of different codes at a plurality of different frequencies. There is also a need for a new way to connect multiple inputs and outputs to a controller so that less I/O ports are needed. There is a further need for a more efficient way of connecting and operating controllers or microprocessors.

SUMMARY OF THE INVENTION

An RF transmitter embodying the present invention provides a simple, compact and inexpensive circuit for transmitting a plurality of different codes at a plurality of different frequencies. The transmitter achieves this by connecting multiple inputs and/or outputs to a controller in a more efficient way so that fewer controller I/O ports are needed. More particularly, the RF transmitter continues to allow user-selection of code and frequency, but multiplexes the input to the controller so that multiple inputs can be coupled to a single controller input without losing the ability to determine the state of each input. In addition, the controller input can operate as both an input and output, thereby minimizing the need for additional I/O ports.

The RF transmitter comprises an input device for selecting among at least two different codes and bit patterns, and for transmitting the selected code and bit pattern at various frequencies as a receiver actuation signal. A three position switch allows the user to select the code the transmitter is to send, (i.e., manufacturer A's code, B's code, C's code, etc.), and DIP switches allow the user to select the bit pattern to be transmitted. The transmitter can be provided with any number of button inputs for transmitting a selected code and frequency. Typically movable barrier operator transmitters are offered in one, two and four button models. While each transmitter is capable of transmitting a plurality of different codes at a plurality of different frequencies, the two and four button transmitters are capable of sending additional receiver actuating signals, (e.g., the four button transmitter can be used to open three separate garage doors and a gate without requiring the user to change the three position switches or the DIP switches on each transmission).

A controller is coupled to the input device and transmitter circuitry. Upon detection of a transmission command signal from a button input, the controller determines which button has been pressed, processes the code and bit pattern selections corresponding to that transmission command signal, and outputs a serial code signal responsive to these selections to the transmitter circuitry. Specifically, the controller determines what code and bit pattern has been selected and outputs the base band code signal to the transmitter circuitry associated with the selected data so that an appropriate receiver actuation signal will be transmitted at an appropriate frequency.

The controller has a plurality of I/O ports (or pins) and is coupled to the bit pattern input device in such a way that it is capable of determining the positions of multiple DIP switches through a single I/O pin. This configuration allows the transmitter to function with a less complicated controller, (i.e., a controller having fewer I/O ports). More particularly, the DIP switches are coupled to discrete logic components on one end and to the controller on the other. The controller I/O pins are pulled high through pull-up resistors and each I/O pin is connected to two DIP switches. One of the DIP switches is connected (on the other side) to ground through a capacitor, while the other is connected to ground through a pull-down resistor. Despite the fact the DIP switches are connected to the same I/O pin, the controller is capable of determining the position of each switch because the presence of the capacitor (or-lack thereof) will effect how the input on the I/O reacts. For example, if the switch connected to the pull-down resistor is closed and the switch connected to the capacitor is open, the I/O pin will be pulled low immediately. However, if both the switch connected to the pull-down resistor and the switch connected to the capacitor are closed, the I/O port will be pulled low slowly.

With such a configuration, four different states can be distinguished via one I/O pin, (thereby accounting for each position of the DIP switches), and the controller can operate much more efficiently. This does not only provide a more efficient controller I/O pin utilization, but it allows a single pin of the controller to be used as both an input and output. The addition of discrete components allows the controller to monitor time and voltage changes, and use each pin for multiple inputs.

Once the controller has processed the various inputs, it can output data responsive to the selected code and bit pattern to transmitter circuitry capable of transmitting an appropriate actuation signal. More particularly, when the processor has determined the various input states, it can output the selected code and bit pattern to transmitter circuitry capable of transmitting the information at the appropriate frequency. For example, if the user has selected code associated with manufacturer A's equipment, has specified a particular bit pattern, and has depressed a transmission pushbutton, the controller will output the appropriate code and bit pattern to the transmitter circuitry that is set up to transmit this information at the frequency specified for manufacturer A's products.

DETAILED DESCRIPTION OF THE PREFERRED EMBODIMENT

Figure 1:
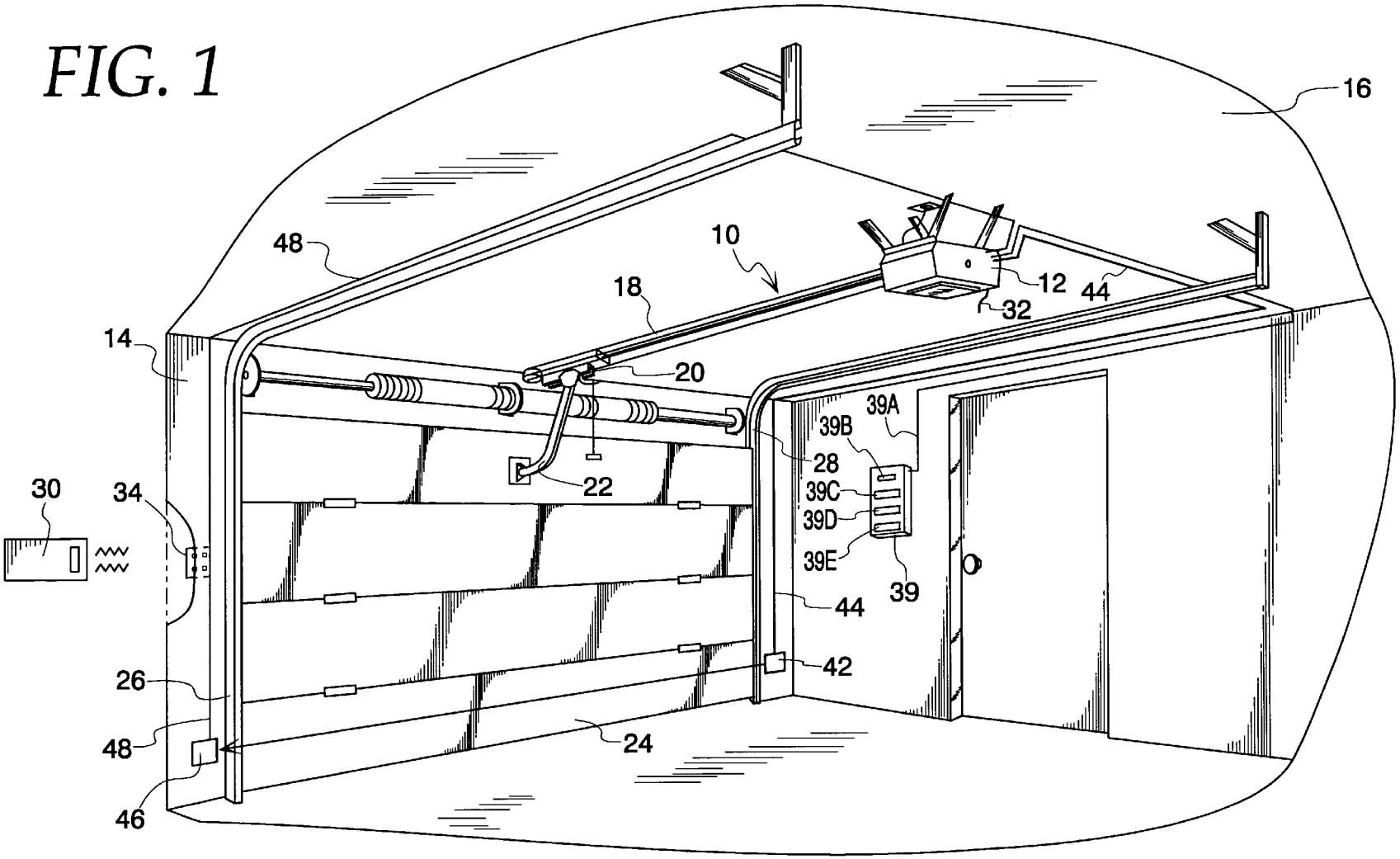
FIG. 1 is a perspective view of an apparatus for moning a barrier or garage door embodying the present invintion.

Referring now to the drawings and especially to FIG. 1, a movable barrier operator embodying the present invention is generally shown therein and identified by reference numeral 10. The movable barrier operator 10 includes a head unit 12 mounted within a garage 14 and is employed for controlling the opening and closing of garage 14. More specifically, the head unit 12 is mounted to the ceiling 16 of the garage 14 and includes a rail 18 extending therefrom with a releasable trolley 20 attached having an arm 22 extending to a multiple paneled garage door 24 positioned for movement along a pair of door rails 26 and 28. The movable barrier operator 10 transfers the garage door 24 between the closed position illustrated in FIG. 1 and an open or raised position, allowing access to and from the garage 14.

The system includes a hand-held transmitter unit 30 adapted to send signals to an antenna 32 positioned on the head unit 12 and coupled to a receiver located within the head unit 12. An external control pad 34 is positioned on the outside of the garage having a plurality of buttons thereon and communicates via radio frequency transmission with the antenna 32 of the head unit 12. The transmitter 30 and control pad 34 are capable of transmitting a plurality of different codes at a plurality of different frequencies, as will be appreciated in more detail hereinafter. A switch module 39 is mounted on a wall of the garage. The switch module 39 is connected to the head unit by a pair of wires 39*a*. The switch module 39 includes a learn switch 39*b*, a light switch 39*c*, a lock switch 39*d* and a command switch 39*e*.

An optical emitter 42 and an optical detector 46 are coupled to the head unit 12 by a pair of wires 44 and 48, respectively. The emitter 42 and detector 46 are used to satisfy the requirements of Underwriter's Laboratories, the Consumer Product Safety Commission and the like which require that garage door operators sold in the United States must, when in a closing mode and contacting an obstruction having a height of more than one inch, reverse and open the door in order to prevent damage to property and injury to persons. A conventional pass point detector or absolute positioning detector may also be used to indicate door position to the controller.

Figure 2:
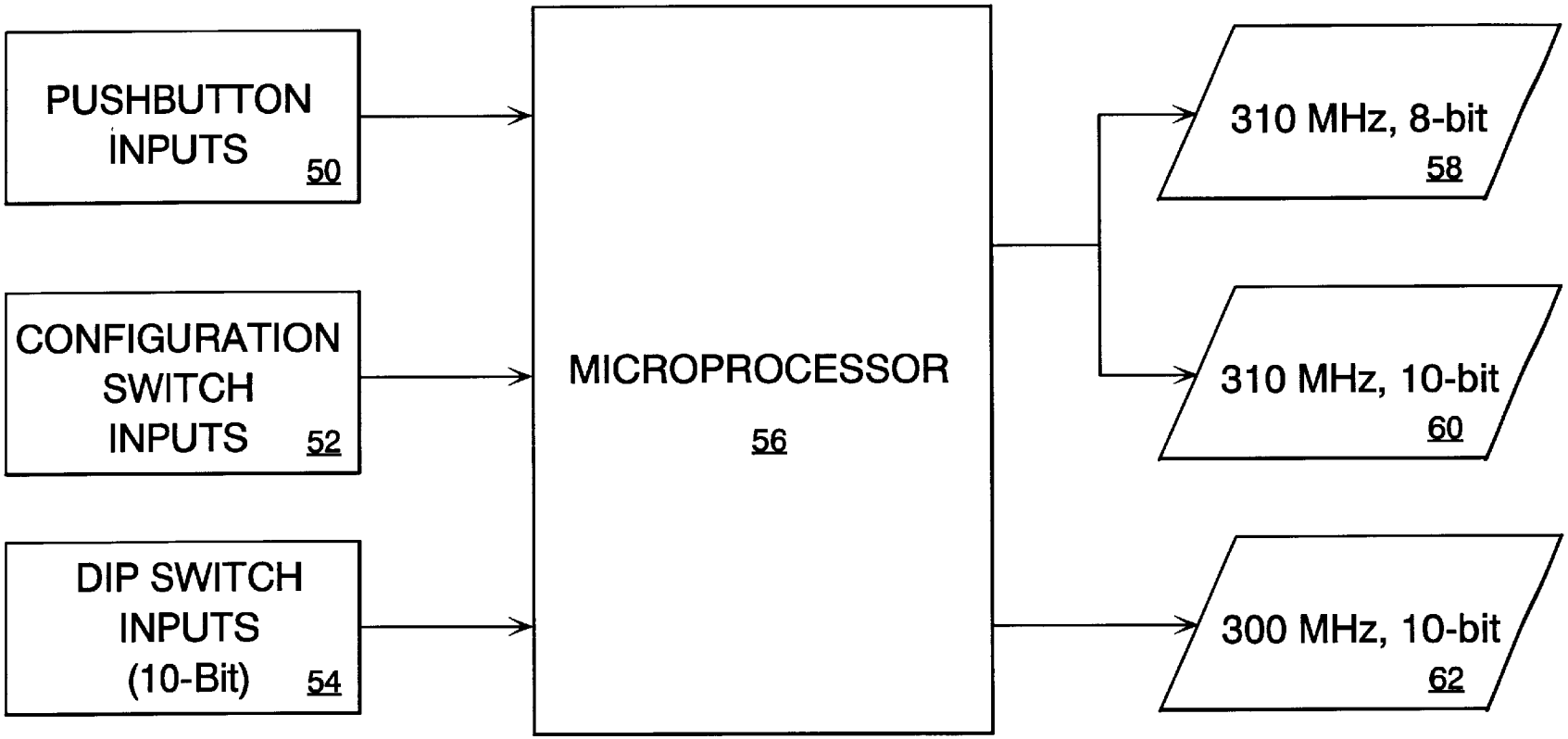
FIG. 2 is a block diagram of a transmitter embodying the present invention.

The transmitter 30 includes a plurality of pushbutton inputs 50, configuration switch inputs 52, DIP switch inputs 54, controller 56, and transmitter circuitry 58, 60, and 62, as shown in FIG. 2. The pushbutton inputs 50 can comprise any number of pushbuttons and operate to send power to the controller 56, (indicating that a receiver actuation signal should be transmitted). The configuration switch input 52 is a multi-position switch that allows the user to select among a plurality of transmitter code modulation schemes. DIP switch inputs 54 allow the user to select among a plurality of different bit patterns, which will be transmitted as part of the receiver actuation signal.

As will be discussed in more detail below, the controller 56 determines which pushbutton 50 has been pressed and what configuration and bit pattern has been selected by configuration inputs 52 and DIP switch inputs 54. The controller 56 then processes the selected information and outputs data to the transmitter circuitry 58, 60, or 62 responsible for transmitting receiver actuating signals at the frequency associate with the selected pushbutton, configuration, and bit pattern input. For example, in FIG. 2, the controller 56 would output data to transmitter circuitry 58 if the inputs 50, 52, and 56 specified transmitting a 8 bit receiver actuation signal at 310 Megahertz (MHz). Similarly, if the inputs 50, 52, and 56 specified transmitting a 10 bit receiver actuation signal at 310 MHz, the controller 56 would output data to transmitter circuitry 60. Likewise, the controller 56 would output data to transmitter circuitry 62 if the inputs 50, 52, and 56 specified transmitting a 10 bit receiver actuation signal at 300 MHz. Note that both the 8 bit and 10 bit receiver actuation signal can be transmitted from a single transmitter circuit since the carrier frequency is 310 MHz for both, (hence the indication in FIG. 2 that each come from the same output pin).

Figure 3:
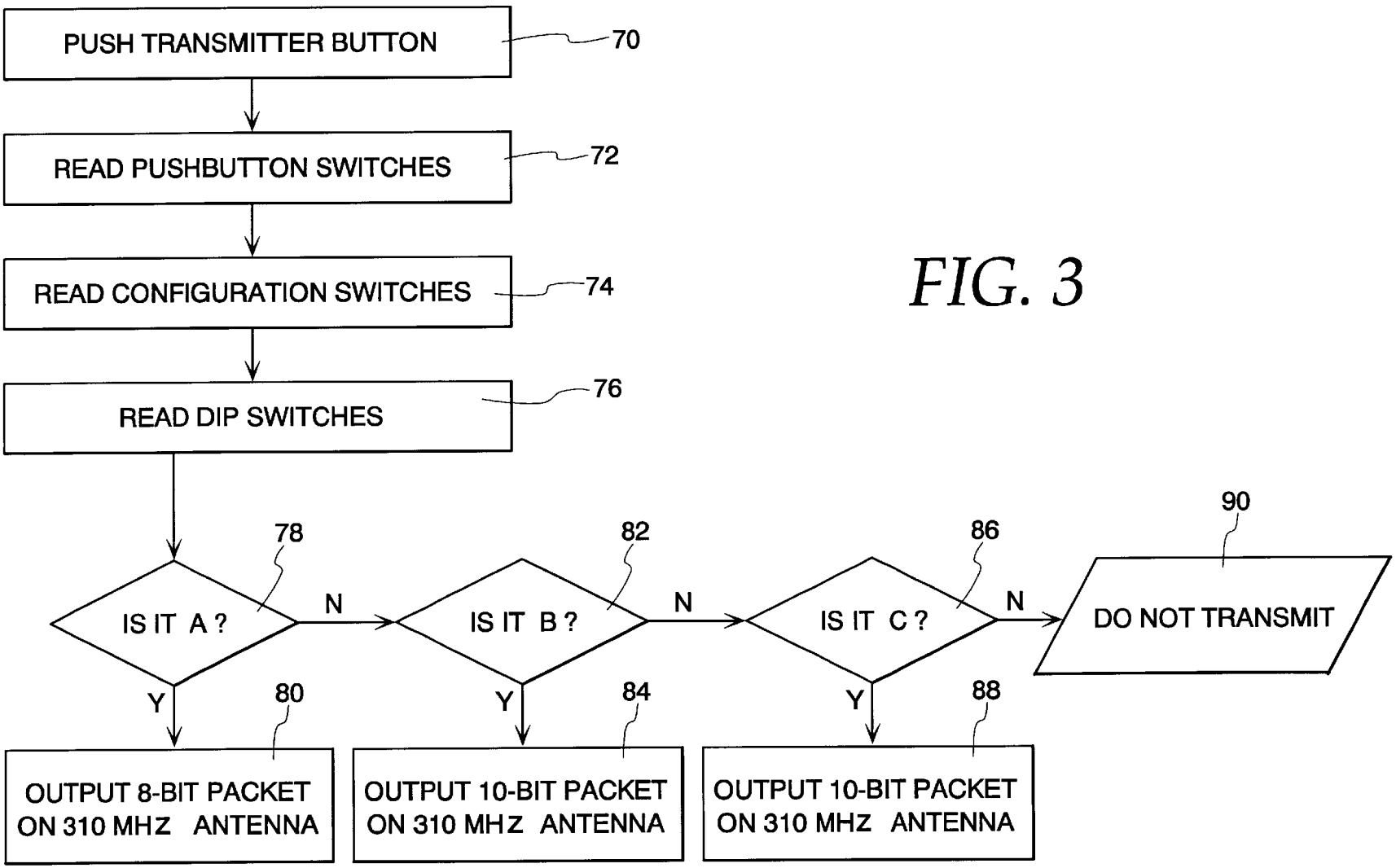
FIG. 3 is an upper level flow chart of the transmitter in FIG. 2.

Referring now to FIG. 3, in which an upper level flow chart of the operation of transmitter 30 is shown. In step 70, one of the pushbutton inputs of the transmitter 30 is pressed. This causes power to be applied to the controller 56. Once power has been applied, the controller 56 takes a reading of the pushbutton switches in step 72 to determine which button was pressed. Then, in step 74, the controller 56 reads the configuration switch settings to determine what code format the receiver actuation signal is to transmitted in. The settings detected are then stored to memory. After determining and storing to memory the code format, the controller 56 reads the DIP switches in step 76. The DIP switches tell the controller what bit-pattern or packet to output. As mentioned above, the transmitter 30 multiplexes two DIP switches into one input pin of the controller 56. The actual process of reading the DIP switches will be discussed further below.

After the DIP switch settings are read and stored in memory, the controller 56 processes the data collected from the inputs and in step 78 checks to see if the user has selected manufacturer A's code format. If A's code is indeed the code selected, the controller outputs data in step 80 to transmitter circuitry configured to transmit a receiver actuation signal at the frequency specified by manufacturer A. Exemplary bit patterns and frequencies have been applied fictitious manufacturers A, B and C in order to provide a more complete understanding of transmitter 30's operation, (e.g., manufacturer A uses a eight bit actuation signal transmitted at 310 MHZ, manufacturer B uses a ten bit actuation signal transmitted at 300 MHz, and manufacturer C uses a ten bit receiver actuation signal transmitted at 310 MHz). Therefore, in step 80, transmitter circuitry will output an eight bit actuation signal at 310 MHz.

If the code selected was not that of A, controller 56 checks in step 82 to see if the code selected was that of manufacturer B. If B's code was selected, the controller outputs data in step 84 to transmitter circuitry configured to transmit a 10-bit receiver actuation signal at 300 MHz. If the code selected was not B, controller 56 checks in step 86 to see if code C was selected. If code C was selected, the controller outputs data in step 88 to transmitter circuitry configured to transmit a 10-bit receiver actuation signal at 310 MHz. If C was not selected, an error has occurred and the controller 56 will not transmit any signal as indicated in step 90. When the transmitter pushbutton is released power is removed and the circuit resets itself. Therefore, if the error is minor and non-recurring, the transmitter should transmit correctly the next time an input button is pressed.

Figure 4A:
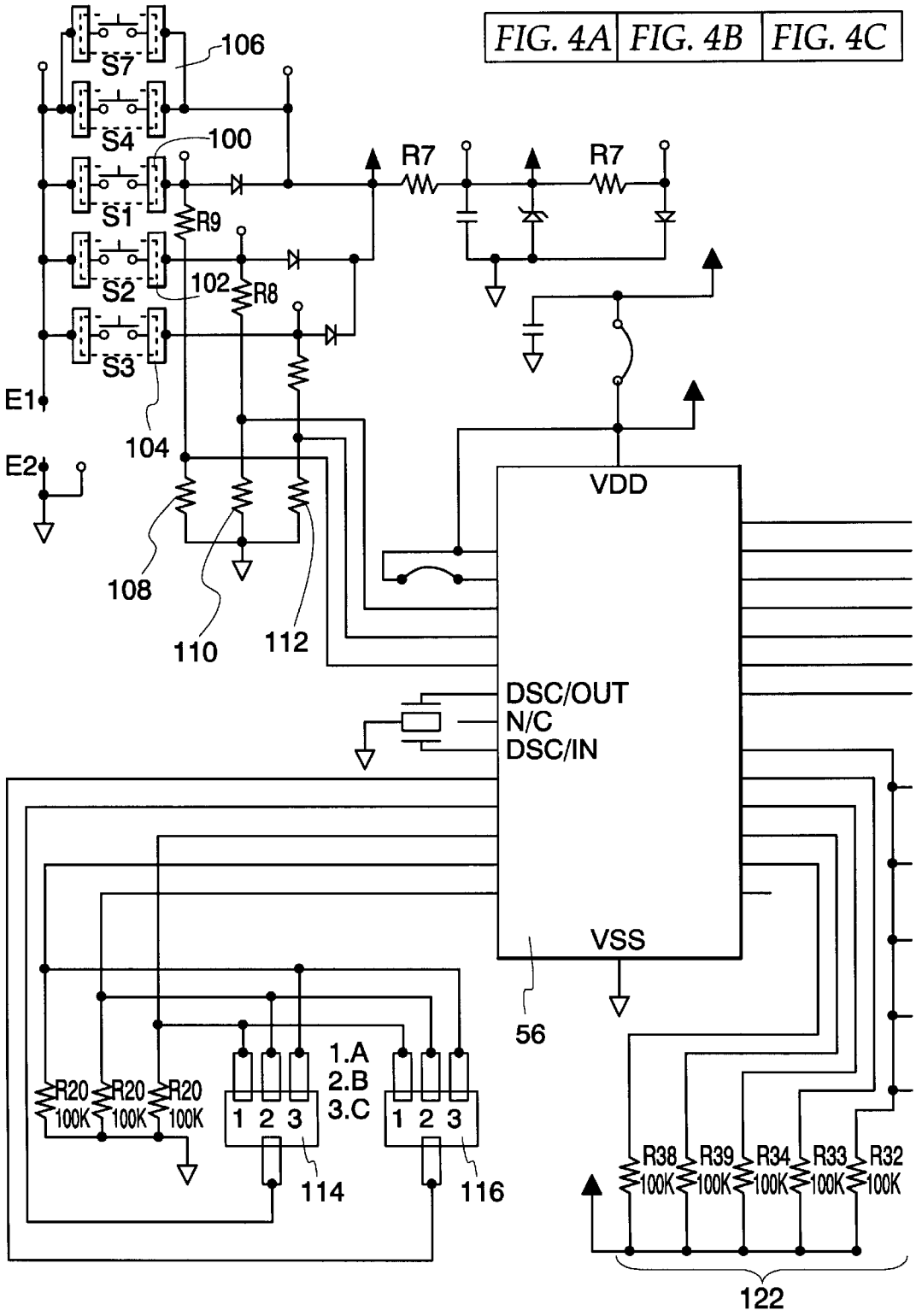
FIGS. 4A-C are a schematic of the transmitter shown in FIG. 3.
Figure 4B:
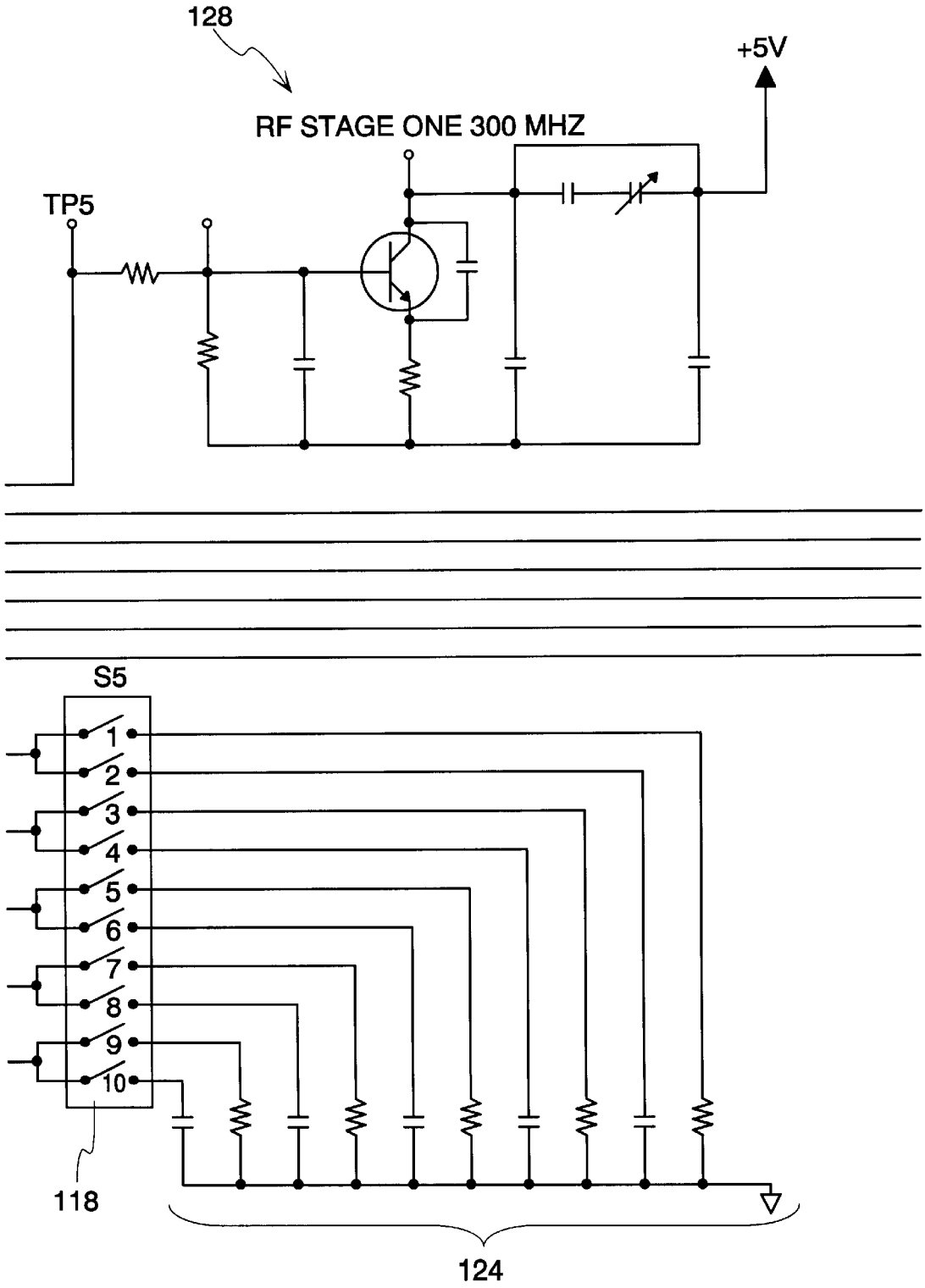
Figure 4C:
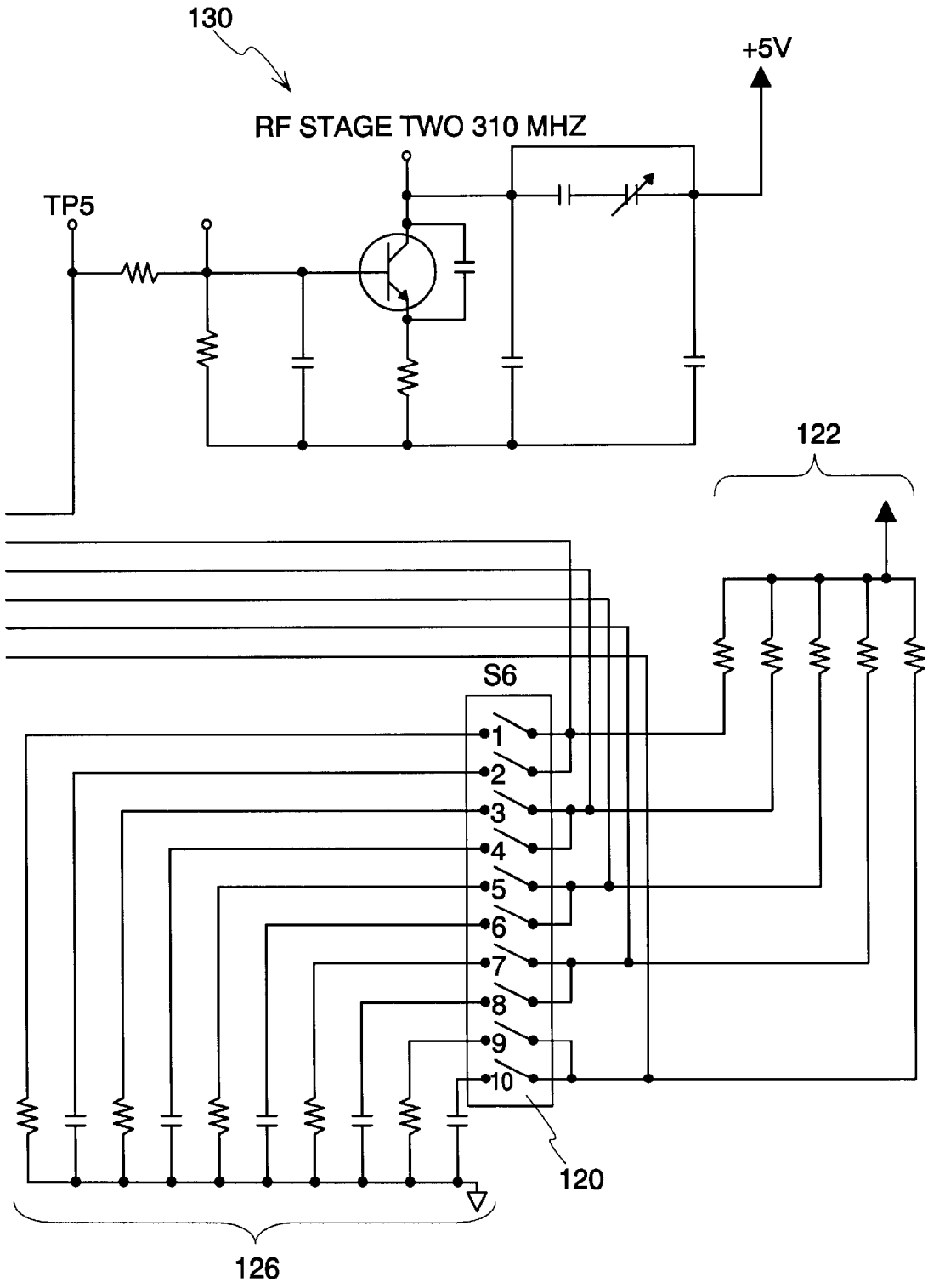
Figure 5A:
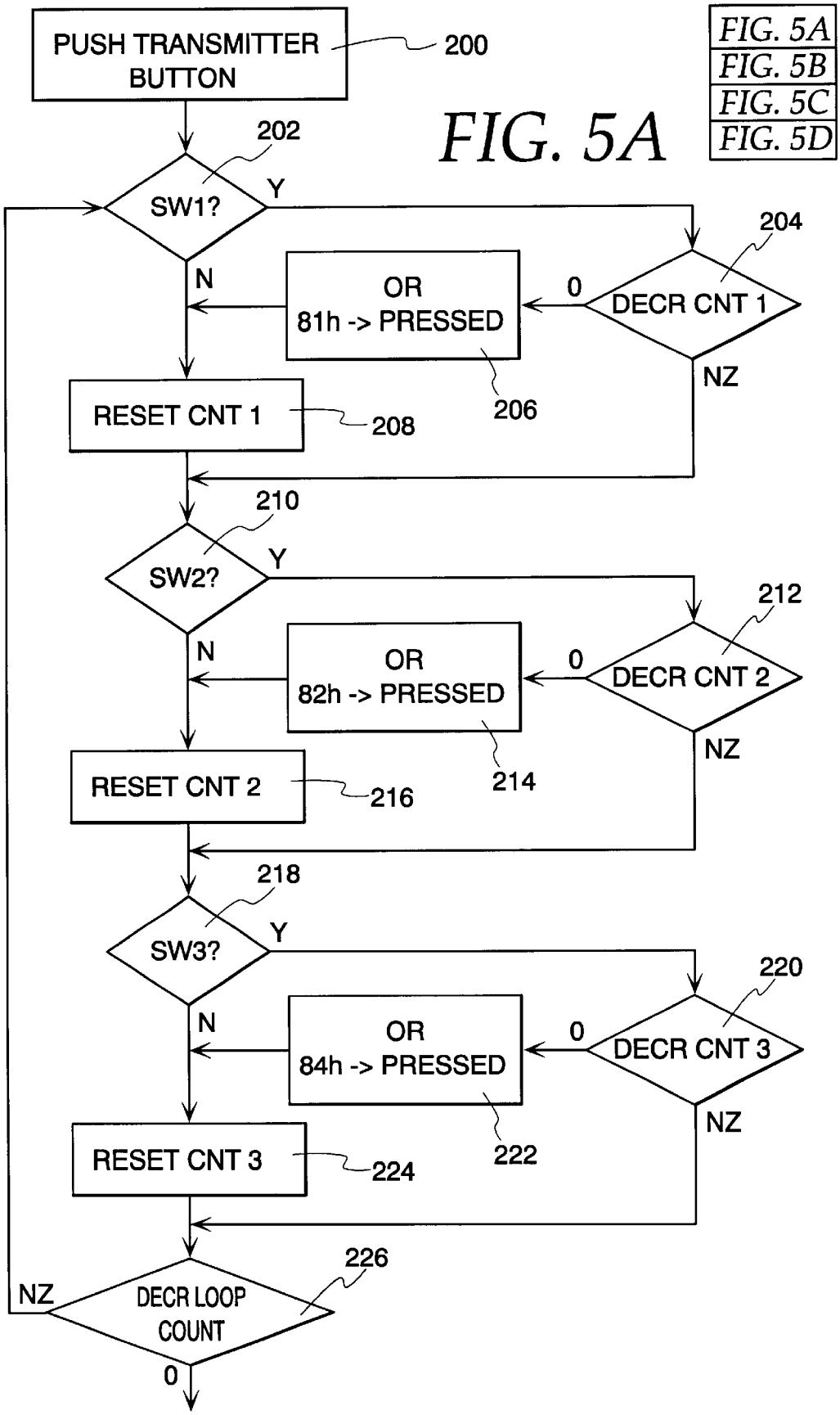
FIGS. 5A-D are flowcharts of the software operating within the controller depicted in FIG. 4.
Figure 5B:
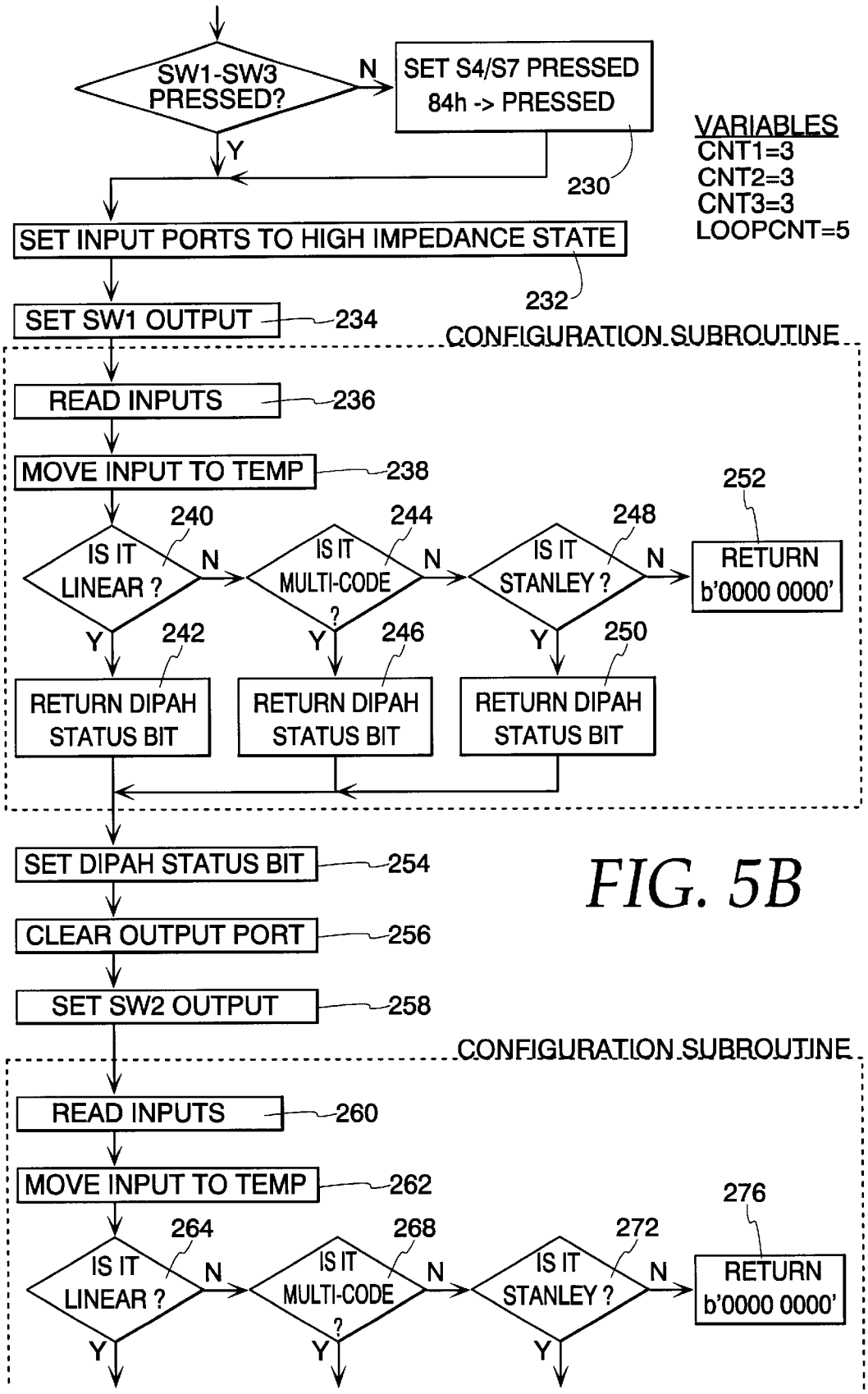
Figure 5C:
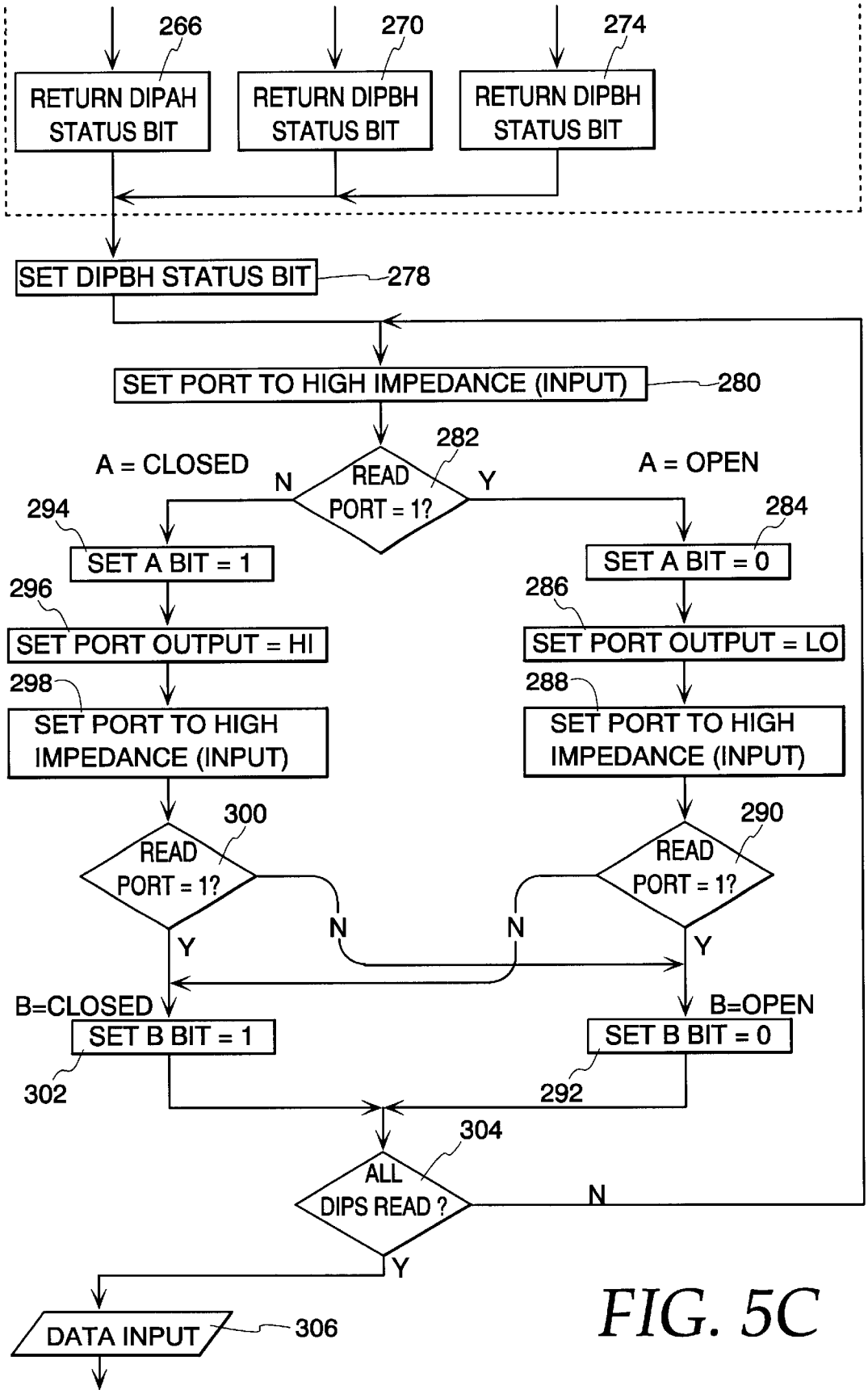
Figure 5D:
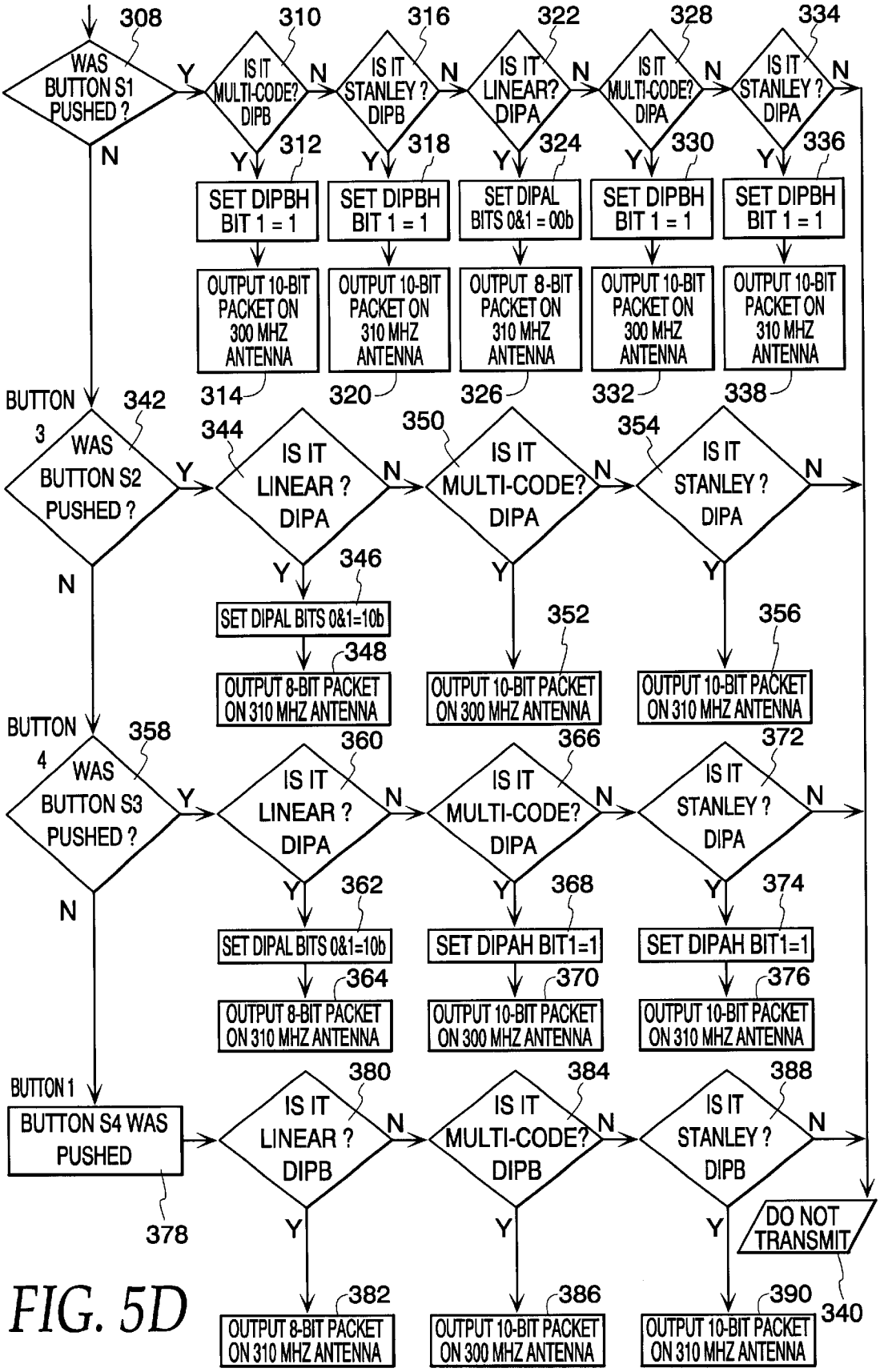

FIGS. 4A-C are a schematic diagram of a four button transmitter 30 embodying the present invention. Pushbuttons S1, S2, S3, and S4/S7 are identified by reference numerals 100, 102, 104, and 106 respectively. In the two button transmitter S1 and S4 are used, and in the four button transmitter Si, S2, S3 and S4 are used. Pushbutton S7 is only used in a one button transmitter, therefore S4 and S7 are paired together. The pushbutton inputs are connected to a power source on one end and to pins R83, R81 and R85 of controller 56 on the other end. Note, only S1, S2 and S3 have inputs into the controller 56. This allows for multiple key presses to be detected, (i.e., each switch may be read at the same time). Pins R83, R81 and R85 are also connected to pull-down resistors 108, 110 and 112, and are therefore normally low (or logic 0). However, when one of the pushbutton inputs 100, 102, 104 or 106 is pressed, the controller pin associated with that switch is driven high and power is applied to the controller 56.

Once power is applied to the controller 56, the controller begins polling or reading the input switches to determine which pushbutton has been pressed. The actual reading process used and debouncing method applied in the controller will be discussed in further detail below. Although S4/S7 do not have an input pin, the controller is able to determine when one of these buttons has been pushed because none of the other switches have been detected, (e.g., by the process of elimination, one of the inputs had to be pushed since the controller received power).

Once power has been applied to controller 56 and the push button inputs 100, 102, 104 and 106 have been read, the controller polls the multi-position switch 114 and 116 to determine what code has been selected to be transmitted as the receiver actuation signal. According to the software executing on controller 56, the port RA2 will be set as an output, pins RB0, RC3 and RA0 will be set as inputs, and RC6 will be set as a high impedance input. Controller 56 outputs a signal over output pin RA2 and reads back the input from pins RB0, RC3 and RA0. The controller reads inputs RB0, RC3 and RA0 in order to determine what position multi-position switch 114 is in. After making this reading, the controller 56 stores the switch position into a register and then sets pins RB0, RC3 and RA0 as inputs and RA2 as a high impedance input, converts port RC6 to an output port and reads pins RB0, RC3 and RA0 to determine what position multi-position switch 116 is in. After making this reading, the controller 56 stores the position of multi-position switch 116 in a registry. Controller 56 then begins to read the position of DIP switch 118 and DIP switch 120.

DIP 118 is connected to controller 56, pins RA3, RC4, RC5, RAl and RC7. These controller ports are also connected to pull-up resistors 122, meaning the ports will be normally high. DIP switch 120 is connected to ports RC2, RC1, RC0, RB7 and RB6 of controller 56. These controller ports are also connected to pull-up resistors 122. In order to achieve the connection between DIP switch 118 and controller 56, and DIP switch 120 and controller 56, the inputs are multiplexed such that two dip switches are read per input port on controller 56. DIP switches 118 and 122 are connected on the side opposite the controller 56 to pull-down resistors and capacitors 124 and 126. This configuration, as will be discussed later, allows the controller to use a minimal amount of I/O ports in order to read the various settings of the DIP switches 118 and 120.

Once the controller has read the position of each DIP switch 118 and 122, the position of each switch is stored in a register that is accessed by the controller to determine the settings of each of the inputs. The controller 56 then outputs a receiver actuation signal according to the input selections that have been previously made. For example, if the input selections indicate that a 8 bit packet or receiver actuation signal is to be sent out on a 310 MHz antenna, the controller 56 outputs from pin RB2 to transmitter circuitry 130. If the selected input indicates that a 10 bit packet is to be transmitted on a 300 MHz antenna, the controller 56 outputs from pin RB4 to transmitter circuitry 128. Likewise, if the selected input indicates that a 10 bit packet is to be transmitted on a 310 MHz antenna, controller 56 outputs from pin RB2 again to transmitter circuitry.

FIG. 5 is a flow chart of the software operating within the controller 56. In step 200 one of the pushbutton inputs 100, 102, 104 or 106 has been pressed. This causes power to be applied to the circuit and initiates controller 56's reading of the pushbutton inputs. In step 202, the controller 56 begins reading the pushbutton inputs by asking if switch 1 has been pressed, (the controller will know if this pushbutton has been pressed based on whether or not the pin associated with that pushbutton has been driven high).

If switch one was pressed, counter 1 (or Cnt1) is decremented in step 204 and the counter is compared to zero. Counter one is initially set equal to three so that three consecutive readings must be made before a switch is determined to have been pressed. The reason for doing this is to debounce the circuit so that false button presses are not detected, (e.g., false logic signals are often received as a result of vibrations or bounces occurring in the mechanical switch). If counter one is equal to zero, three consecutive readings have been received (indicating that this button has indeed been pressed) and the PRESSED register is updated in step 206 to indicate that switch one was pressed. The term "eight one" is representative of the binary register string 1000 0001, with the first "1"in the string of eight bits signifying that button one, two or three was pushed, and the second "1" signifying that switch one was pushed. Once the PRESSED register is updated, counter one is reset in step 208 and the controller moves on to step 210. If after step 204 counter one is not equal to zero the controller moves to step 210 to poll whether or not switch two has been pressed. If switch two was pressed, counter 2 (or Cnt2) is decremented in step 212 and the counter is compared to zero. Similar to counter one, counter two is set equal to three so that three consecutive readings must be read before a switch is determined to have been pressed. If counter two is equal to zero, three consecutive readings have been received and the PRESSED register is updated in step 214 to indicate that switch two was pressed. The term "eight two" is representative of binary register string 1000 0010, with the first "1" in the eight bit string signifying that button one, two or three was pushed, and the second "1" signifying that switch two was pushed. Once the PRESSED register is updated, counter two is reset in step 216 and the controller moves on to step 218. If after step 212 counter two is not equal to zero the controller moves to step 218 to poll whether or not switch three has been pressed.

If switch three was pressed, counter 3 (or Cnt3) is decremented in step 220 and the counter is compared to zero. Similar to counters one and two, counter three is set equal to three so that three consecutive readings must be read before a switch is determined to have been pressed. If counter three is equal to zero, three consecutive readings have been received and the PRESSED register is updated in step 222 to indicate that switch three was pressed. The term "eight four" is representative of the binary register string 1000 0100, with first "1" signifying that button one, two or three was pushed, and second "1" signifying that switch three was pushed. Once the PRESSED register is updated, counter three is reset in step 224 and the controller moves on to step 226. If after step 220 counter three is not equal to zero the controller moves to step 226 to decrement the loop counter (or LoopCnt) and poll whether or not the pushbutton input pins have been read five times.

The loop counter is initially set to five so that the controller will poll or read the pushbutton input pins a minimum of five times. This serves to ensure that only true switch presses are detected, (i.e., debouncing). If after the last decrement in step 226 the loop counter is not equal to zero, the controller will go back and read all of the pushbutton inputs again starting at step 202. However, if after the decrement in step 226 the loop counter is equal to zero, (meaning five loops have occurred), control is shifted to step 228 in which the controller looks to see if any of switches 1, 2, or 3 were pressed. If none of these switches were pressed the PRESSED register is updated in step 230 to indicate that switch 4/7 has been pressed. The term "zero eight" is representative of the binary register string 0000 1000, with both the first "0" and the "1" signifying that button four was pushed. Once the PRESSED register has been updated, control is shifted to step 232. If step 228 indicates that switch one, two or three have been pressed the controller moves to step 232 to begin reading the configuration switches.

The controller reads the configuration switches in order to determine the type of code that is to be transmitted as a receiver actuation signal, (e.g., manufacturer A's code, manufacturer B's code, etc.). In step 232 and 234, the input ports are set to high impedance and the controller pin coupled to switch one is set to output. This is done to eliminate the risk of cross talk between ports. For example, in FIG. 4 the controller 56 has separate output pins RC6 and RA2 driving the configuration switches and shared inputs RB0 RC3 RA3 receiving the responses. If one of the output pins is driven high and the other output pin is driven low, and the configuration switches are set to the same position, a short will occur between the output pins, which can damage the controller 56. In order to avoid this, steps 232 and 234 set the pins RC6, RB0, RC3 and RA3 to high impedance inputs and set output pin RA2 high so no damage can occur to the controller.

Once the output has been driven high and the input signal has settled, the controller moves to step 236 and polls the three input pins to determine which have been driven high. Since the controller waits for the signal to settle, no debouncing routine is necessary. In step 238, the input received by the controller is stored in a temporary register (TEMP). Since the configuration and DIP switches will impact the output waveform for the receiver actuation signal, the configuration and DIP switch input will be stored in the same registers. These registers can be configured as follows:

Configuration and DIP Switch Registers

| | Bit 7 | Bit 6 | Bit 5 | Bit 4 | Bit 3 | Bit 2 | Bit 1 | Bit 0 |
|---|---|---|---|---|---|---|---|---|
| DIPAH | A | B | C | x | x | x | 10 | 9 |
| DIPAL | 8 | 7 | 6 | 5 | 4 | 3 | 2 | 1 |
| DIPBH | A | B | C | x | x | x | 10 | 9 |
| DIPBL | 8 | 7 | 6 | 5 | 4 | 3 | 2 | 1 |

In step 240, the controller checks to see if manufacturer A's code was selected. If it was, the controller sets the status bit associated with this manufacturer high in the configuration switch registers. For example, if manufacturer A's code was selected the controller would return a DIPAH status bit in step 242 and set the DIPAH status bit in step 254. If the selected code was not A's code, the controller 56 would move to step 244 and check to see if manufacturer B's code was selected. If manufacturer B's code was selected, the controller would return a DIPAH status bit in step 246 and set the DIPAH status bit in step 254. If manufacturer B's code was not selected the controller would move to step 248 and check to see if manufacturer C's code was selected. If C's code was selected, the controller would return a DIPAH status bit in step 250 and set the DIPAH status bit in step 254. If C's code was not selected an error has occurred and the controller will return a binary 0000 0000 in step 252. This would call DIE and the transmitter would not transmit.

Once the first configuration switch settings have been detected and the DIPAH status bit has been set in step 254, the entire read configuration process will start over again, but this time the controller will read the second configuration switch. In steps 256 and 258 the controller clears the output, sets the pins RA2, RB0, RC3 and RA3 to high impedance inputs, and sets output pin RC6 high so no damage can occur to the controller.

Once the output has been driven high and the input signal has settled, the controller moves to step 260 and again polls the three input pins to determine which have been driven high. In step 262, the input received by the controller is stored in a temporary register (TEMP). In step 264, the controller checks to see if manufacturer A's code was selected. If A's code was selected the controller would return a DIPBH status bit in step 266 and set the DIPBH status bit in step 278. If the selected code was not A's code, the controller 56 would move to step 268 and check to see if manufacturer B's code was selected. If B's code was selected, the controller would return a DIPBH status bit in step 270 and set the DIPBH status bit in step 278. If manufacturer B's code was not selected the controller would move to-step 272 and check to see if manufacturer C's code was selected. If C's code was selected, the controller would return a DIPAH status bit in step 274 and set the DIPAH status bit in step 278. If C's code was not selected an error has occurred and the controller will return a binary 0000 0000 in step 276. This occurrence will call DIE and the transmitter will not transmit.

Once the DIPBH status bit has been set the controller moves to step 280 and begins reading the DIP switches to determine the bit pattern the receiver actuation signal is to have. Prior to reading the DIP switches, the controller sets the ports coupled to the DIP switches to high impedance inputs (i.e., zeroing ports). Note, the DIP switches are multiplexed into the controller 56 (meaning that more than one switch is connected to one controller pin). In step 282 the controller reads the port coupled to the first set of DIP switches to determine if it is high (or a logic 1). If the port is high, the DIP switch connected to the pull down resistor is open. In step 284, the controller sets the bit that represents the switch connected to the pull down resistor to 0 (indicating that the switch is open). In step 286 the controller sets the port as an output and drives it low. Then in step 288, the controller sets the port to a high impedance input, (note the controller is using this port as both an input and an output, or as an I/O port).

After the controller has set the port to a high impedance input, the controller moves to step 290 and reads the port input. If the port input is high (or goes high very fast), the DIP switch connected to the capacitor is open and the controller moves to step 292 and sets the bit that represents the switch connected to the capacitor to 0 (indicating that the switch is open). If the port input is not high (or is moving high slowly), the DIP switch connected to the capacitor is closed and the controller moves to step 302 and sets the bit that represents the switch connected to the capacitor to 1 (indicating that the switch is closed).

If during step 282 the controller reads the port coupled to the first set of DIP switches and determines that it is not high, the controller moves to step 294 and sets the bit that represents the switch connected to the pull down resistor to 1 (indicating that the switch is closed). Next, in step 296, the controller sets the port as an output and drives it high. Then in step 298, the controller sets the port to a high impedance input.

After the controller has set the port to a high impedance input, the controller moves to step 300 and reads a the port input. If the port input is still high (or gradually going low), the DIP switch connected to the capacitor is closed and the controller moves to step 302 and sets the bit that represents the switch connected to the capacitor to 1 (indicating that the switch is closed). If the port input is not high (or is rapidly going low), the DIP switch connected to the capacitor is open and the controller moves to step 292 and sets the bit that represents the switch connected to the capacitor to 0 (indicating that the switch is open).

After steps 292 and 302, the controller moves to step 304 and determines whether all of the DIP switches have been read or not. In order to do this, the controller could be set up with a counter (similar to the push button loop counter), that will be decremented each time a set of DIP switches is read until all of the DIP switches have been read. If all of the DIP switches have not been read yet, the controller loops back to step 280 and performs all of the procedures previously discussed for the first set of DIP switches all over again. For example, the controller will set the port coupled to the second set of DIP switches to a high impedance input and read the port to determine the initial state of the switch connected to the pull down resistor. The controller will set the bit that represents that switch accordingly and then check to see if the switch connected to the capacitor is open or closed. After determining the status of the switch connected to the capacitor the controller will set the bit that represents that switch accordingly and again check to see if all the DIP switches have been read. This process will continue until all the DIP switches have been read (and all the DIP switch positions have been accounted for).

Once all of the DIP switches have been read, the controller moves to step 306 and processes the input data stored in the controller's registries. In a four button transmitter the controllers moves to step 308 and determines whether or not button S1 has been pushed. Because the controller is capable of detecting this by looking at the controller registries and determining whether or not button S1's bit has been set. If push button S1 was pushed, the controller moves to step 310 and determines whether or not manufacturer of B's code was selected in DIPB. If B's code was selected in DIPB, the controller moves to step 312 and sets Bit 1 and DIPB equal to 1. Then the controller moves to step 314 and outputs a 10 bit receiver actuation signal on a 300 MHz antenna.

If manufacturer B's code is not selected in DIPB the controller moves to step 316 and determines whether or not manufacturer sees codes have been selected in DIPB. If manufacturer sees code has been selected in DIPB, the controller moves to step 318 and sets bit 1 of DIPBH equal to 1. The controller then moves to step 320 and outputs a 10 bit receiver actuation signal on a 310 MHz antenna. If manufacturer sees code has not been selected in step 316, the controller moves to step 322 and determines whether or not manufacturer A's code has been selected in DIPA. If A's code was selected in DIPA, the controller moves to step 324 and sets DIPA bits 0 and 1 equal to 00. Then the controller moves to step 326 and outputs and 8 bit receiver actuation signal on a 310 MHz antenna.

If manufacturer A's code was not selected, the controller moves to step 328 and determines whether or not manufacturer B's code has been selected in DIPA. If B's code was selected in DIPA, the controller moves to step 330 and sets bit 1 of DIPB equal to 1. Then the controller moves to step 332 and outputs a 10 bit receiver actuation signal on a 300 MHz antenna. If manufacturer of B's code was not selected in DIPA the controller moves to step 334 and determines whether or not manufacturer C's code has been selected in DIPA. If manufacturer of C's code has been selected in DIPA, controls shifts to step 336 and bit 1 of DIPB is set equal to 1. Then the controller moves to step 338 and outputs a 10 bit packet or receiver actuation signal on a 310 MHz antenna. If the controller determines manufacturer C's code was not selected in DIPA control is then shifted to step 340 in which an error has occurred and no receiver actuation signal will be transmitted. If button S1 was not pushed, the controller moves to step 342 and determines whether or not button S2 (button 3) has been pushed. If button S2 was pushed, the controller moves to step 344 and determines whether or not manufacturer A's code has been selected in DIPA. If A's code has been selected the controller moves to step 346 and sets bits 0 and 1 of DIPA equal to 10. Then the controller moves to step 348 and outputs and 8 bit packet (4 receiver actuation signal) on an 310 MHz antenna.

If the controller determines that manufacturer A's code has not been selected control is shifted to step 350. In step 350, the controller determines whether or not manufacturer B's code has been selected in DIPA. If manufacturer B's code has been selected, the controller moves to step 352 and outputs a 10 bit receiver actuation signal on a 310 MHz antenna. If the controller determines that manufacturer B's code has not been selected, the controller moves to step 354 and determines whether or not manufacturer C's code has been selected. If manufacturer C's code has been selected, the controller moves to step 356 and outputs a 10 bit receiver actuation signal on a 310 MHz antenna. If the controller determines that manufacturer C's code has not been selected, control is shifted to step 340 where an error has occurred and no receiver actuation signal will be transmitted. If button S2 was not pushed, the controller moves to step 358 and determines whether or not pushed button S3 (button 4) was pushed. If button S3 was pushed, the controller moves to step 360 and determines whether or not manufacturer A's code has been selected in DIPA. If A's code has been selected, it's 0 and 1 of DIPA are set equal to 01. Then the controller moves to step 364 and outputs an 8 bit receiver actuation signal on an 310 MHz antenna.

If manufacturer A's code was not selected the controller moves to step 366 and determines whether or not manufacturer B's code has been selected. If B's code was selected the controller moves to step 368 and sets bit 1 of DIPA =1. Then the controller shifts to step 370 and outputs a 10 bit receiver actuation signal on a 300 MHz antenna. If B's code was not selected the controller moves to 372 and determines whether or not manufacturer C's code has been selected. If manufacturer C's code has been selected, bit 1 of DIPA set equal to 1 in step 374. Then in step 376, the controller outputs a 10 bit receiver actuation signal on a 310 MHz antenna. If manufacturer C's code has not been selected, control shifts to step 340 when error has occurred and no receiver actuation signal is transmitted. If button S3 was not pushed, the controller moves to step 378 and specifies that button S4 (button 1) must have been pushed. Then the controller moves to step 380 and determines whether or not manufacturer A's code has been selected.

If manufacturer A's code has been selected, the controller move to step 382 and outputs and 8 bit receiver actuation signal on 310 MHz antenna. If manufacturer A's code was not selected, the controller moves to step 384 and determines whether or not manufacturer B's code has been selected. If B's code was selected the controller moves to step 386 and outputs a 10 bit receiver actuation signal on a 300 MHz antenna. If B's code was not selected, the controller moves to step 388 and determines whether or not manufacturer C's code was selected. If manufacturer C's code was selected, the controller moves to step 390 and outputs a 10 bit receiver actuation on a 310 MHz antenna. If the controller determines that manufacturer C's code was not selected, control shifts to step 340 in which an error has occurred and no receiver actuation signal will be transmitted.

Figure 6:
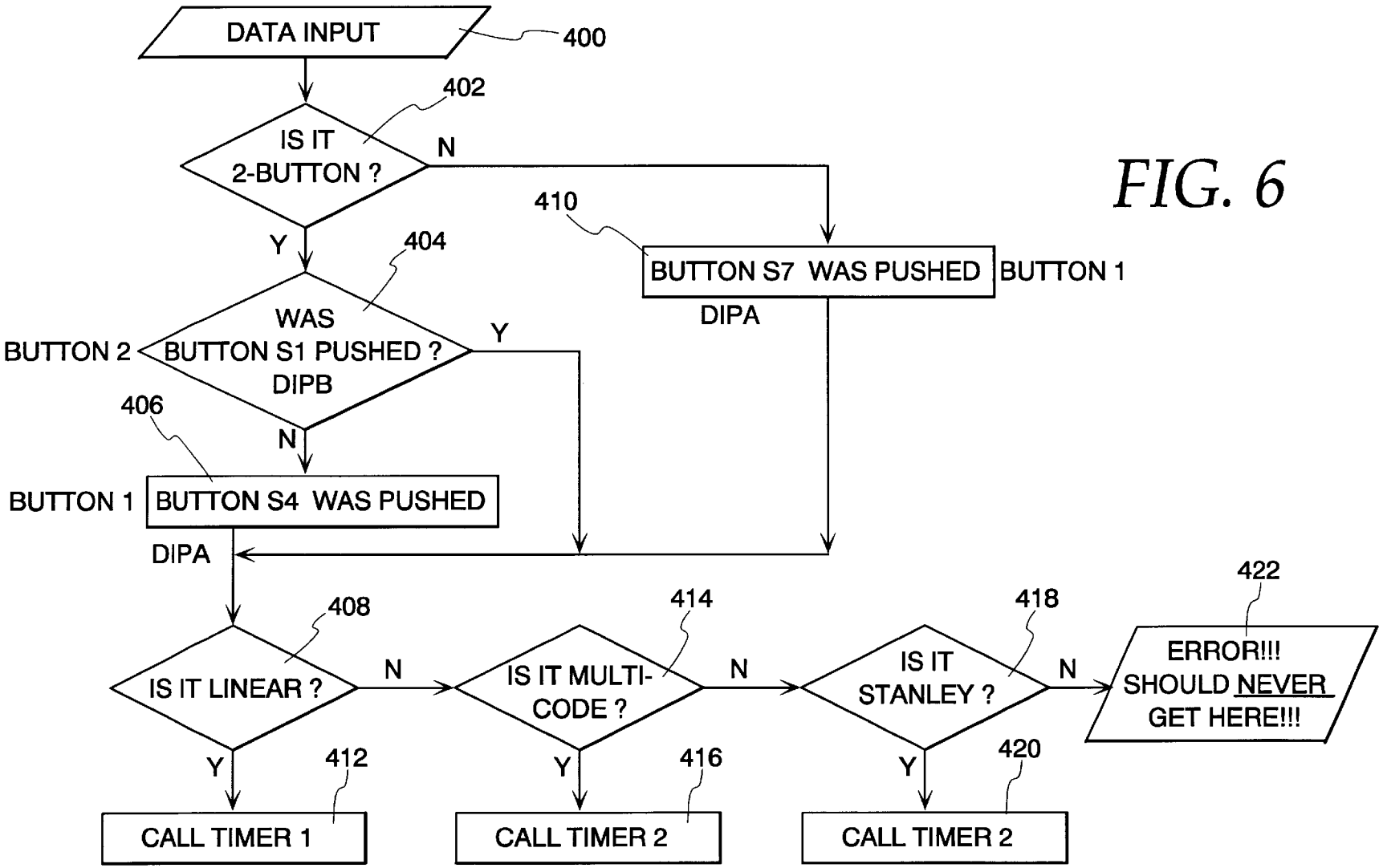
FIGS. 6 is a flowchart of the RF waveform output software operating within the controller of a one and two button transmitter.

A flowchart depicting how the controller software treats a one and two button transmitter for purposes of RF waveform output is shown in FIG. 6. Specifically, the controller processes all of the data input in step 400 and moves to step 402 to determine if the transmitter is a two button transmitter. The controller accomplishes this by reading the information previously stored in the transmitter registers to see if the two button transmitter bit is set. If the transmitter is a two button transmitter, the controller moves to step 404 and determines whether push button input S1 was pushed? Again, the controller can determine this by reading the transmitter registers to identify what switch was pushed. If the controller determines that S1 was not pushed, S4 must have been pushed (as is indicated in step 406) because there are only two buttons on the transmitter. Once this has been determined, the controller moves to step 408 and looks at the DIPA registers to determine what type of code has been selected. If the controller in step 404 determines that Si was pushed, control shifts to step 408 where the controller will look to the DIPB registers to determine what type of code has been selected. If the controller determines in step 402 that the transmitter is not a two button transmitter, the controller knows (as is depicted in step 410) that there must only be one input and that button S7 was pushed. After making this decision, the controller moves to step 408 where it will look to the DIPA registers to determine what code has been selected.

In step 408 the controller will look to the transmitter registers to determine whether or not the code selected was that of manufacturer A. If A's code was selected the controller will call timer 1 in step 412. Timer 1 is used to output one of the manufacturer's packets, (e.g., output 8-bit receiver actuating signal on a 310 MHz antenna). If A's code was not selected the controller moves from step 408 to step 414 and determines if manufacturer B's code was selected. If B's code was selected, the controller calls timer 2 in step 416. Timer 2 may be used to output manufacturer B's code and manufacturer C's code. This timer could output a waveform on a 310 MHz antenna and/or on a 300 MHz antenna. The antenna selection may depend on the bit pattern selected. The timers also allow for varying timing parameters (e.g., various transmission rates for highs and lows, or logic ones and zeros).

Figure 7B:
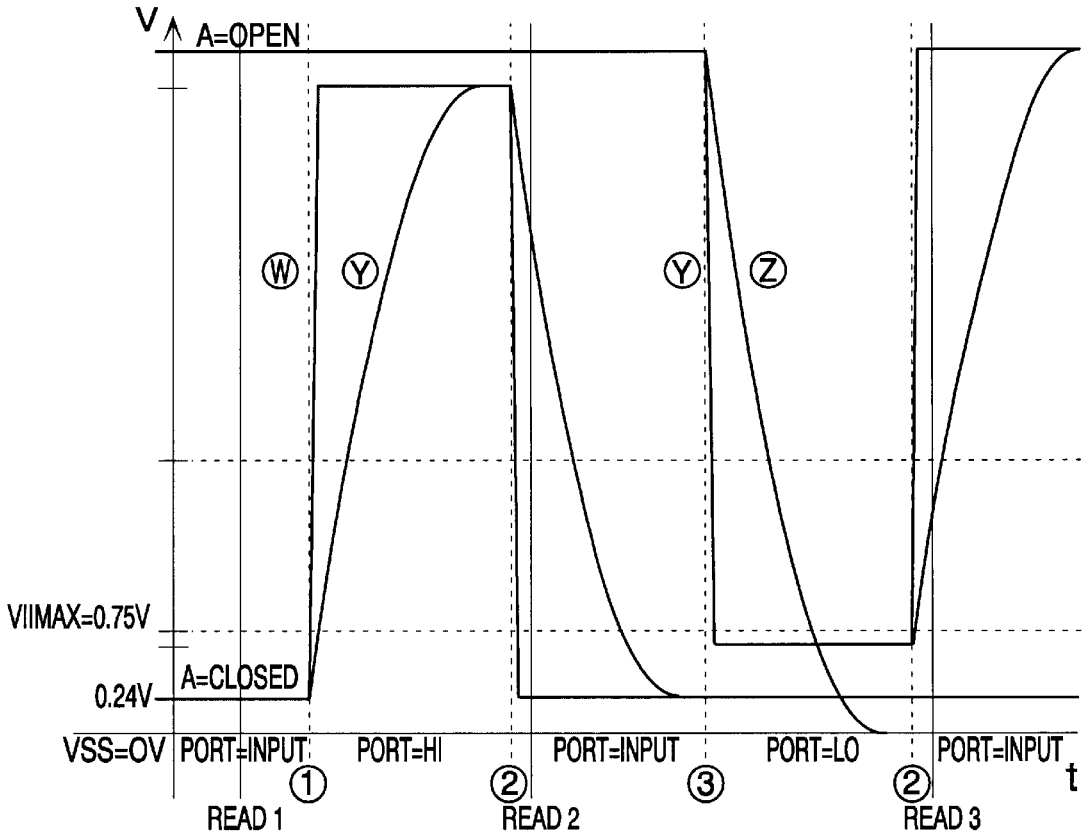
FIG. 7B is a graph of the DIP switch waveforms produced from the circuitry shown in FIG. 7A.
Figure 7A:
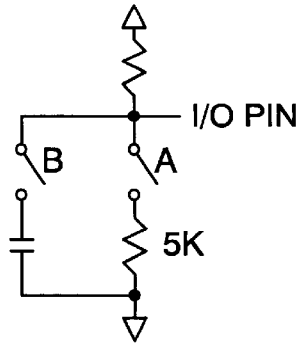
FIG. 7A is a schematic diagram of the DIP switch multiplexing circuitry shown in FIG. 4.

FIG. 7A is a schematic diagram of the DIP switches multiplexing circuitry used in FIG. 4, and FIG. 7B is a graph of the DIP switch waveforms produced from the circuitry shown in FIG. 7A. More particularly, FIG. 7A is a schematic illustration showing how one set of DIP switches are multiplexed into one I/O pin of the controller 56. The letter "A" has been assigned to the DIP switch connected to the pull down resistor, and the letter "B" has been assigned to the DIP switch connected to the capacitor.

FIG. 7B is a graphical representation of what the DIP switch waveforms look like to the controller. This graph shows how the controller 56 can determine which of the two states each DIP switch is in (deciphering four states in total). As mentioned above, the controller first polls the A DIP switch to determine if it is open or closed. If the switch is open, the pin input will initially be high due to pull up resistors shown in FIG. 4. If the switch is closed the pin input will initially be low due to the DIP switch being connected to a pull down resistor. The controller converts the pin to an output and outputs a signal opposite to that of the pins initial or natural signal (i.e., if pin input was high initially, the controller drives the pin low). Then the controller converts the pin back into an input and looks to see what signal is coming in. If the controller drove the pin high, and only the switch A was closed, the input would almost instantly return low. However, if switch B was closed as well, it would take some time for the signal on the pin go low. Therefore, the controller is capable of determining the state of each DIP switch by manipulating the controller pin between an input and an output, and by multiplexing the DIP switches in a unique way. A listing of the software executing on the controller is attached in an Appendix hereto, (A1–A11).

Thus it is apparent that there has been provided, in accordance with the invention, a method and apparatus for transmitting a plurality of codes at a plurality of different frequencies that fully satisfies the objects, aims, and advantages set forth above. While the invention has been described in conjunction with specific embodiments and methods thereof, it is evident that many alternatives, modification, and variations will be apparent to those skilled in the art in light of the foregoing description. Accordingly, it is intended to embrace all such alternatives, modifications, and variations as fall within the spirit and broad scope of the appended claims.

What is claimed is:

1. A transmitter capable of transmitting a plurality of different codes at a plurality of different frequencies, comprising:

a plurality of input devices for specifying a plurality of different codes and a plurality of different bit patterns;

a controller for identifying the different codes and bit patterns by driving and reading pins coupled to said input devices as both outputs and inputs of the controller;

multiplexing circuitry for assisting said controller in driving and reading said input devices; and transmitter circuitry coupled to said controller for transmitting bit patterns identified by the controller at different frequencies.

2. The transmitter of claim 1 wherein said input devices comprise multi-position switches for selecting among a plurality of different codes and DIP switches having a plurality of individual switches for selecting among a plurality of different bit patterns.

3. The transmitter of claim 2, wherein said multiplexing circuitry comprises resistors and capacitors coupled to said DIP switches which allow the controller to detect positions of the individual switches.

4. The transmitter of claim 3 wherein the controller comprises at least one pin connected to a pair of individual switches, one of the pair individual switches being connected to a resistor and one of the pair of individual switches being connected to a capacitor.

5. The transmitter of claim 4, the controller drives and reads at the least one pin to identify states of the individual switches of the pair.

6. A radio frequency transmitter capable of transmitting a plurality of codes at a plurality of different radio frequencies comprising:

an input device for selecting among at least two codes and bit patterns, and for transmitting said selected code and bit pattern as a receiver actuation signal;

a controller having a plurality of input pins coupled to said input device for processing said code and bit pattern selections and transmitting output signals responsive to said selections, wherein said controller processes multiple information pertaining to a plurality of said selections from one input pin; and transmitter circuitry coupled to said controller for receiving said controller output and transmitting said receiver actuation signal.

7. A radio frequency transmitter for actuating a movable barrier operator receiver, each transmitter being capable of transmitting a plurality of codes at a plurality of radio frequencies comprising:

a first input device for selecting transmission of a receiver actuation signal;

second and third user-selectable input devices for selecting a specified code and a specified bit pattern for said actuation signal transmission;

a controller having multiple input pins coupled to said input devices for processing said transmission, code and bit pattern selections and for outputting data responsive to said code and bit pattern input to transmitter circuitry, wherein said controller processes multiple information pertaining to a plurality of said selections from one input pin; and transmitter circuitry for transmitting said output data at various frequencies associated with said input selections.

8. The radio frequency transmitter of claim 7, wherein said first input device is a push button input device which initiates transmission of said receiver actuation signal.

9. The radio frequency transmitter of claim 8, wherein said second user-selectable input device comprises a multi-position switch which determines a particular code to be transmitted as said actuation signal based upon the position of said multi-positioned switch.

10. The radio frequency transmitter of claim 9, wherein said third user-selectable input device comprises a DIP having a plurality of inner switches which determine a particular bit sequence to be transmitted as said actuation signal based upon the position of said plurality of inner switches.

11. The radio frequency transmitter of claim 10, wherein said controller processes the code, bit sequence and transmission selections from said input devices and outputs data according to said input to transmitter circuitry to transmit particular data at one frequency and other data at another frequency.

* * * * *

UNITED STATES PATENT AND TRADEMARK OFFICE

CERTIFICATE OF CORRECTION

PATENT NO. : 6,822,603 B1
APPLICATION NO. : 09/557801
DATED : November 23, 2004
INVENTOR(S) : Crimmins et al.

It is certified that error appears in the above-identified patent and that said Letters Patent is hereby corrected as shown below:

In the Claims:

In Col. 13, line 58, after "pair" (first occurrence), insert -- of --;

In Col. 14, line 1, after "4", insert -- wherein --;

In Col. 14, line 2, after "at", insert -- the --;

In Col. 14, line 48-49, after "DIP", insert -- switches --.

Signed and Sealed this

Sixth Day of November, 2007

JON W. DUDAS
*Director of the United States Patent and Trademark Office*